US005727476A

United States Patent [19]

Priore, Sr.

[11] Patent Number: 5,727,476

[45] Date of Patent: Mar. 17, 1998

[54] CONVERTIBLE OTTOMAN-TABLE

[76] Inventor: Ronald J. Priore, Sr., 32 Tamarack Rd., Westwood, Mass. 02090

[21] Appl. No.: 743,142

[22] Filed: Nov. 4, 1996

[51] Int. Cl.[6] ..... A47B 85/00

[52] U.S. Cl. ..... 108/13; 297/423.45

[58] Field of Search ..... 108/12, 13, 8, 108/19, 11, 144, 106, 91; 297/423.41, 423.44, 423.45

[56] References Cited

U.S. PATENT DOCUMENTS

| | | | |
|---|---|---|---|
| 561,955 | 6/1896 | Asper | 108/18 |
| 1,683,711 | 9/1928 | Burwell | 108/13 X |
| 1,862,010 | 6/1932 | Ehrlich | 108/13 X |
| 2,615,771 | 10/1952 | Curtis | 108/11 X |
| 3,120,410 | 2/1964 | Berg | 297/423.41 X |
| 3,744,845 | 7/1973 | Sooker | 108/12 X |
| 4,563,181 | 1/1986 | Gansel et al. | 108/12 X |
| 4,892,043 | 1/1990 | Schulz | 108/90 |
| 5,261,334 | 11/1993 | Chevoor | 108/12 X |
| 5,360,264 | 11/1994 | Crane | 108/13 X |

FOREIGN PATENT DOCUMENTS

| | | | |
|---|---|---|---|
| 8804904 | 7/1988 | WIPO | 297/423.41 |

*Primary Examiner*—Jose V. Chen
*Attorney, Agent, or Firm*—Arthur A. Smith, Jr.

[57] ABSTRACT

A multipurpose ottoman is described, consisting of a base unit having two supporting walls which rest on an underlying surface, and a top unit including a tabletop configured to receive a cushion or other items such as tableware, games or the like. The tabletop has two supporting walls which are designed to fit within the walls of the base unit and two support flaps connected by hinges to the tabletop. The support flaps are approximately parallel to the outside surfaces of the tabletop walls and are shorter in height than these walls.

When it is desired that the assembly function as an ottoman, the supporting walls of the tabletop are lowered within the supporting walls of the base unit, and the support flaps are moved slightly to fit over a portion of the outer surfaces of the base unit's walls so that the tabletop rests on the unit. When a table is desired, the top unit is lifted upwards, the support flaps are pushed slightly inward to rest on the top surfaces of the base unit's supporting walls and against the supporting walls of the tabletop, securely holding the top unit in place.

Optional features include a footstool and a slideable drawer.

9 Claims, 5 Drawing Sheets

CONVERTIBLE OTTOMAN-TABLE

FIELD OF THE INVENTION

This invention relates generally to footstool-type ottomans and, more specifically, to an ottoman that is convertible into a table and also can be used as a step-stool.

BACKGROUND OF THE INVENTION

The ottoman is a commonly used piece of furniture in many homes. It originated as a means of providing a support platform for elevation of the feet from the floor, thereby allowing a more relaxed position for leisure time as, for example, reading or watching television. This remains its primary use.

Over the years, however, the trend has been to enhance the capabilities of the basic ottoman as, for example, by providing it with a storage capability for articles, including books, magazines, cards, games, shoes, etc., as in U.S. Pat. No. 2,812,227 to Hill, U.S. Pat. No. D160,390 to Hubbert, U.S. Pat. No. 5,466,041 to Hoffman, et al, U.S. Pat. No. 3,746,391 to Novak, U.S. Pat. No. D173,074 to McMaster; by designing it to convert into a bed, as in U.S. Pat. No. 4,212,090 to Ehrlich; or into a bar, as in U.S. Pat. No. 2,812,227 to Hill; or into a cocktail table, tray and storage closet, as in U.S. Pat. No. D250,860. In a somewhat related field, stools have also been invented to convert into a writing desk and storage compartment, as in U.S. Pat. No. 2,564,338 to McCarroll; and to function as a rolling stool with storage, as in U.S. Pat. No. D351,508 to Bonazza.

The present invention differs from the prior art in that it can be quickly and easily converted into a table which is stable and does not employ complex linkage. As converted, it can be used to serve snacks, play games, provide a base for objects such as a television video game or computer, or serve as a seat or an elevated leg rest. The invention also optimally provides a slide-through drawer for storage, which can be accessed from either side of the unit, and a step, which is detachable, or can be stored within the unit when not in use, and which converts the unit into a step stool.

It is, therefore, an object of the invention to provide an ottoman that can be quickly and easily converted into a game table without complicated linkage but having stability.

It is another object of the invention to provide an ottoman that can also be used as a secure step or footstool.

It is yet another object of the invention to provide a multi-functional ottoman that optimizes valuable floor space.

It is yet another object of the invention to provide an ottoman that also provides a drawer means for storage.

SUMMARY OF THE INVENTION

These and other objects are fulfilled by the present invention which includes an ottoman assembly comprising a base unit having two outer walls configured to rest on an underlying surface; a top unit having a tabletop configured to receive a cushion and having two inner walls rigidly affixed to the tabletop and two support flaps attached to the tabletop by hinges such that when the inner walls are lowered inside the base unit and the support flaps over the outside of the base unit (i.e., in the closed position), the tabletop unit rests on the base unit and the assembly can be used as a coffee table, or, when a cushion is placed on the tabletop, as an Ottoman; and when the inner walls (of the top unit) are raised, the support flaps rest securely on the top corners of the outer walls of the base, allowing the unit to function as a table.

In the preferred embodiment, a drawer or shelf may be located immediately below the tabletop and configured on sliders such that it may be opened from either end. As another optional feature, a flip-down step or footstool may be stored within the base unit. The stool is attached to the inside surface of the outer walls such that it is easily pulled out for use.

DETAILED DESCRIPTION OF THE INVENTION

The present invention relates to an ottoman which is easily and simply converted into a table for game playing, snacks or other such activities. It also incorporates, as optional features, a drawer for storing objects, as well as a step (or foot) stool. A detailed description of the invention is given by reference to the drawings.

Figure 1:
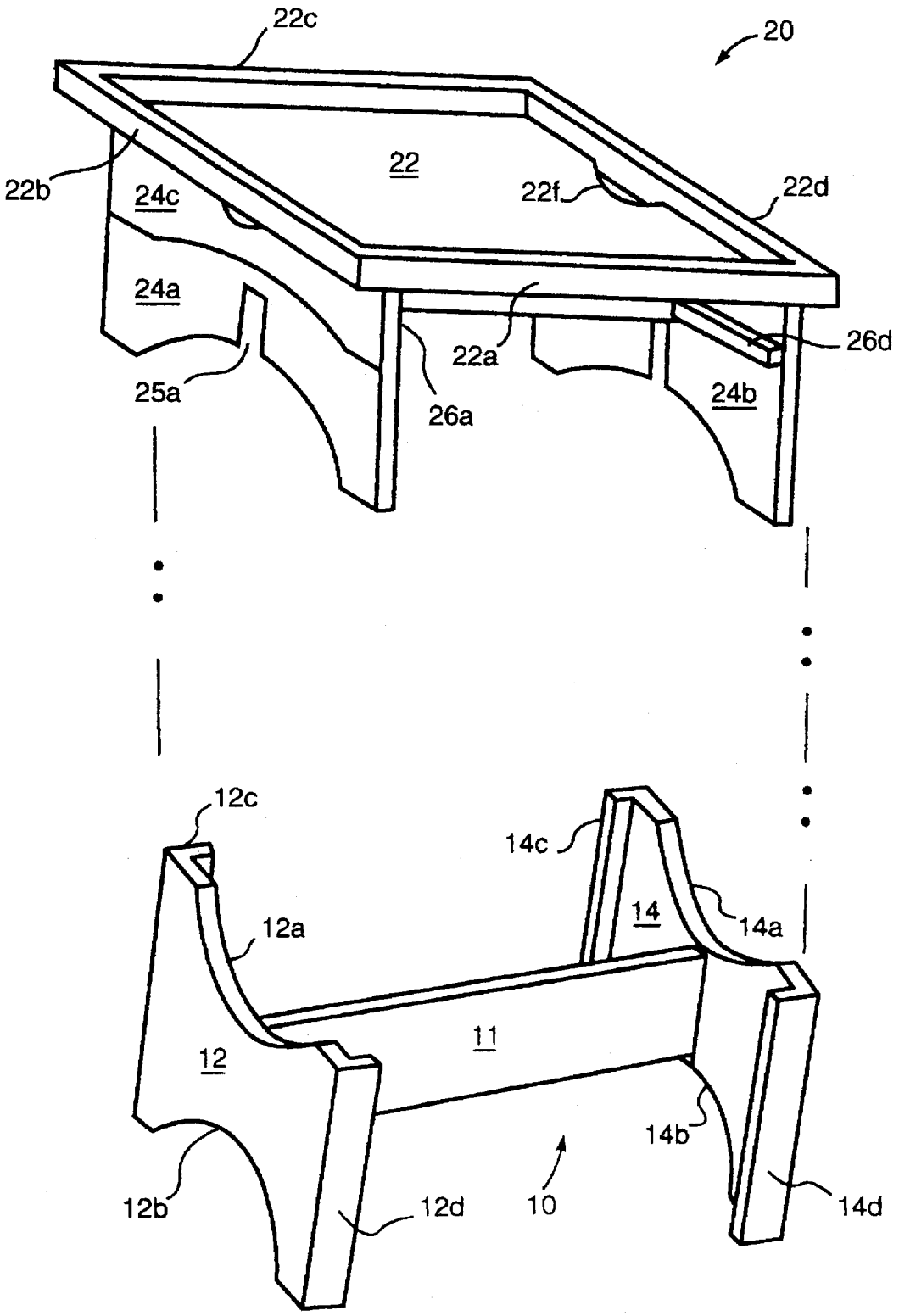
FIG. 1 is an exploded view of the ottoman showing the base unit and the top unit and suggesting the manner in which the top unit fits relative to the base unit.

FIG. 1 shows base unit 10 comprising outer wall means 12 and 14, which are rigidly connected together by frame 11, which, in turn, extends horizontally between said walls. Outer walls 12 and 14 are each configured such that a substantial portion of their top surfaces **12*a* and 14*a*, respectively, and their bottom surfaces 12*b* and 14*b*, respectively, are cut out in a semi-circular or semi-spherical shape. The opposing ends of each of said walls 12 and 14 are joined to facings 12*c* and 12*d* and 14*c* and 14*d*, respectively, creating an L-shaped support groove from the top to the bottom of each of the corners of outer walls 12 and 14**.

In the preferred embodiment, the approximate dimensions of base unit 10 include: outer walls 12 and 14 being 13 inches high and 16 inches long. Said outer walls are fabricated of ¾ inch thick plywood with facings **12*c*, 12*d*, 14*c* and 14*d* of ½ inch thick plywood with a length of 1½ inches. Frame 11 is 4¼ inches high. Base unit 10's outer dimensions are 13 inches high by 18⅞ inches wide, measured from the outer surface of outer wall 12 to that of outer wall 14**, by 16 inches deep.

FIG. 1 also shows top unit 20 comprising tabletop 22 configured, in the preferred embodiment, in a rectangular shape having four walls **22*a*, 22*b*, 22*c*and 22*d* along the perimeter of tabletop 22 which serve to hold a cushion in place when the assembly functions as an ottoman, or, in the absence of a cushion, to prevent objects on tabletop 22 from sliding off when the assembly is used as a table. Slots 22*e* (not shown) and 22*f* are cut into tabletop 22** for ease of gripping.

Tabletop 22 is affixed rigidly to inner walls **24*a* and 24*b*. Support flaps 24*c* and 24*d* are connected to tabletop 22 by hinges located at or in close proximity to the corners of tabletop 22 and hanging parallel with the outer surfaces of inner walls 24***a* and 24*b*. Support flaps 24*c* and 24*d* have a height less than the height of inner walls 24*a* and 24*b*. The support flaps 24*c* and 24*d* hang at approximately a right angle to tabletop 22 but with slight pressure can be caused to move inward or outward (i.e., to traverse an arc to attain less than or more than a 90-degree position to said tabletop). The distance between inner walls 24*a* and 24*b* of top unit 20 is slightly less than the distance between outer walls 12 and 14 of base unit 10. Likewise, the length of said inner walls is slightly less than the length of said outer walls. As a result, the ends of the inner walls fit snugly within the L-shaped grooves of outer walls 12 and 14 when top unit 20 is lowered into base unit 10 to form the closed position for an ottoman.

The bottom surfaces of each of inner walls 24*a* and 24*b* are cut out in a semi-circular or semi-spherical shape in the center of each of which is a slot 25*a* and 25*b* (not shown), respectively. Slots 25*a* and 25*b* enable inner walls 24*a* and 24*b* to fit over and rest on frame 11. Said slots can also be used to grip top unit 20 when it is in the open position in order to slide it inside base unit 10.

To form the ottoman, i.e., the closed position, top unit 20 is fitted within base unit 10 by sliding inner walls 24*a* and 24*b* downward into the L-shaped support grooves of outer walls 12 and 14. Simultaneously, a slight outward pressure is applied manually to support flaps 24*c* and 24*d* such that the support flaps slide downward over the outer surfaces of outer walls 12 and 14 until tabletop 22 rests on top of base unit 10.

To form the game table, i.e., the open position, top unit 20 is raised partially upwards by gripping slots 22*e* and 22*f* in tabletop 22. When support flaps 24*c* and 24*d* reach above the top of outer walls 12 and 14, a slight pressure is applied to force the support flaps inward such that they rest on the top of the four corners of outer walls 12 and 14. The support flaps are held securely in place since they rest against inner walls 24*a* and 24*b*.

Attached to the inner surfaces of inner walls 24*a* and 24*b* are sliders 26*a* and 26*b* extending in a horizontal plane from one end of each of said inner walls to the other. When inserted onto said sliders, drawer 27 can slide along them between an open or closed position from either end of top unit 20.

In the preferred embodiment, the dimensions of top unit 20 include: support flaps 24*c* and 24*d* being 6½ inches high and 15¾ inches long; inner walls 24*a* and 24*b* being 14⅞ inches long and 13 inches high; the outer distance between said inner walls being 17⅝ inches. The outer dimensions of tabletop 22 being 21⅛ inches wide and 17⅛ inches long (deep).

All of the above dimensions may vary depending on the size of the ottoman assembly which is desired for a particular location. It is only necessary that the distance between inner walls 24*a* and 24*b* of top unit 20 be slightly less than the distance between outer walls 12 and 14 of base unit 10. This is to ensure that in the assembly's closed position, i.e., when top unit 20 is fitted inside base unit 10, top unit 20 fits snugly within the L-shaped support grooves of base unit 10.

Further, although, in the preferred embodiment the ottoman assembly is fabricated of plywood or other types of wood, it could also be made of plastic, metal or other materials.

Additionally, if it is not desired to have drawer 27 open on either end of top unit 20, another inner wall and support flap could be attached to the back of tabletop 22 by changing the dimensions of the assembly accordingly.

Figure 2:
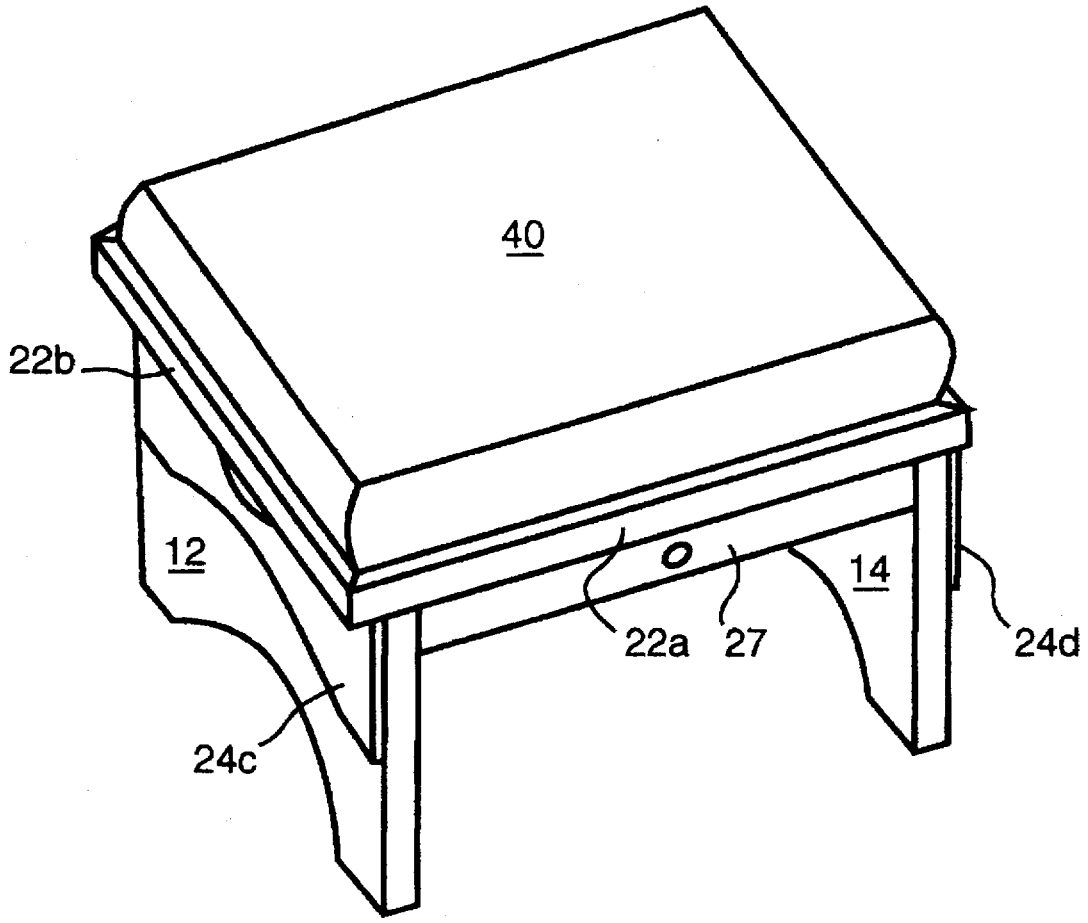
FIG. 2 is a perspective view of the ottoman in its closed position, with the cushion and drawer.

FIG. 2 shows the ottoman assembly in its closed position, i.e., after top unit 20 has been inserted into base unit 10. As previously explained, support flaps 24*c* and 24*d* hang over the outside of outer walls 24*a* and 24*b* at about a 90-degree angle to tabletop 22. In the closed position, the ottoman can be used as a low coffee table or, as shown in FIG. 2, when cushion 40 is placed onto tabletop 22, the assembly functions as an ottoman. As previously explained, cushion 40 is held in place by tabletop walls 22*a*, 22*b*, 22*c* and 22*d*. Drawer 27 is shown in its closed position in FIG. 2.

Figure 3:
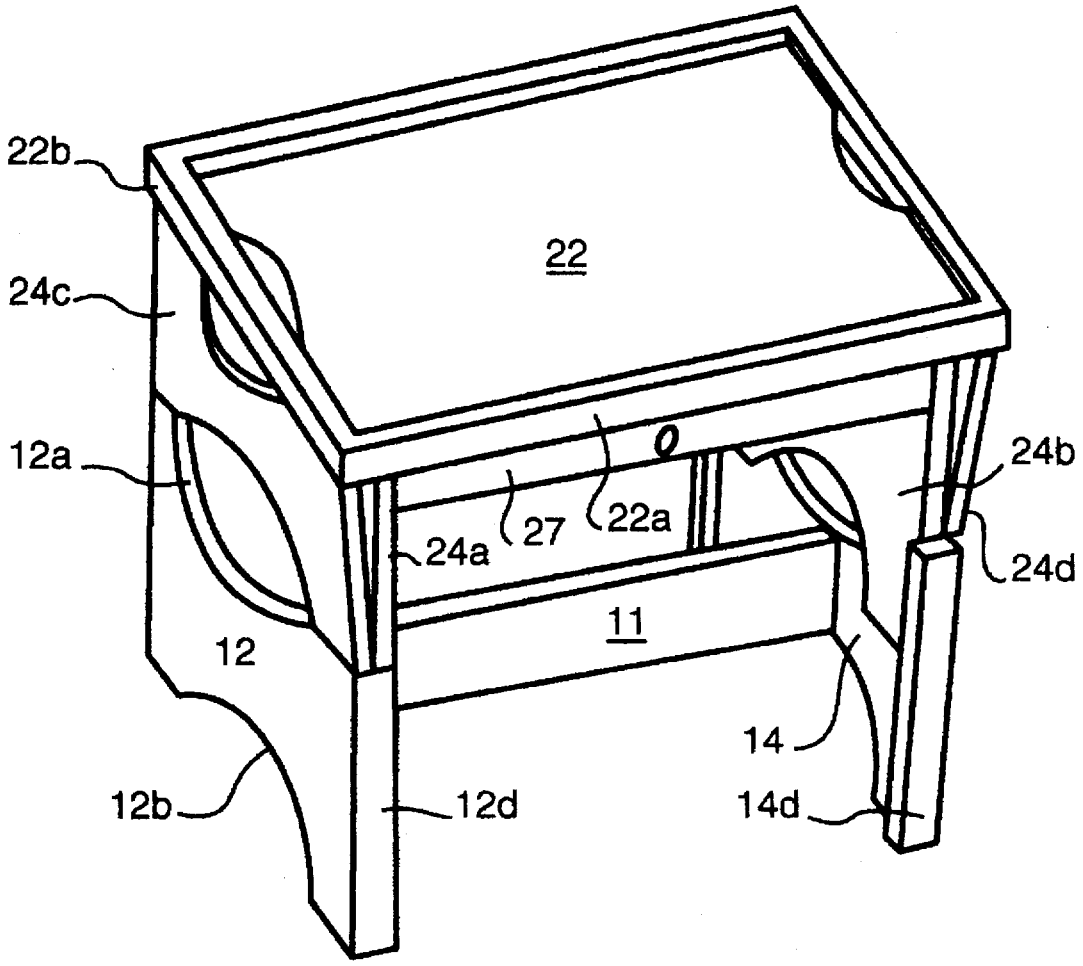
FIG. 3 is a perspective view of the ottoman in its open position, without the cushion, showing the support flaps of the top unit resting on the top corners of the outer walls of the base unit and held securely by the inner walls of the top unit.

FIG. 3 shows the ottoman assembly in its open position, i.e., after top unit 20 has been slid upwards from within base unit 10. When support flaps 24*c* and 24*d* extend just beyond the top of outer walls 12 and 14, the manual application of slight pressure causes the flaps to move inward towards each other until they abut against inner walls 24*a* and 24*b* such that they rest, in a secure position, on the top corners of outer walls 12 and 14.

In the preferred embodiment, the assembly, in its open position, is high enough to function as a table. As shown in FIG. 3, cushion 40 has been removed, allowing tabletop 22 to be used as a table for games or eating.

Figure 4:
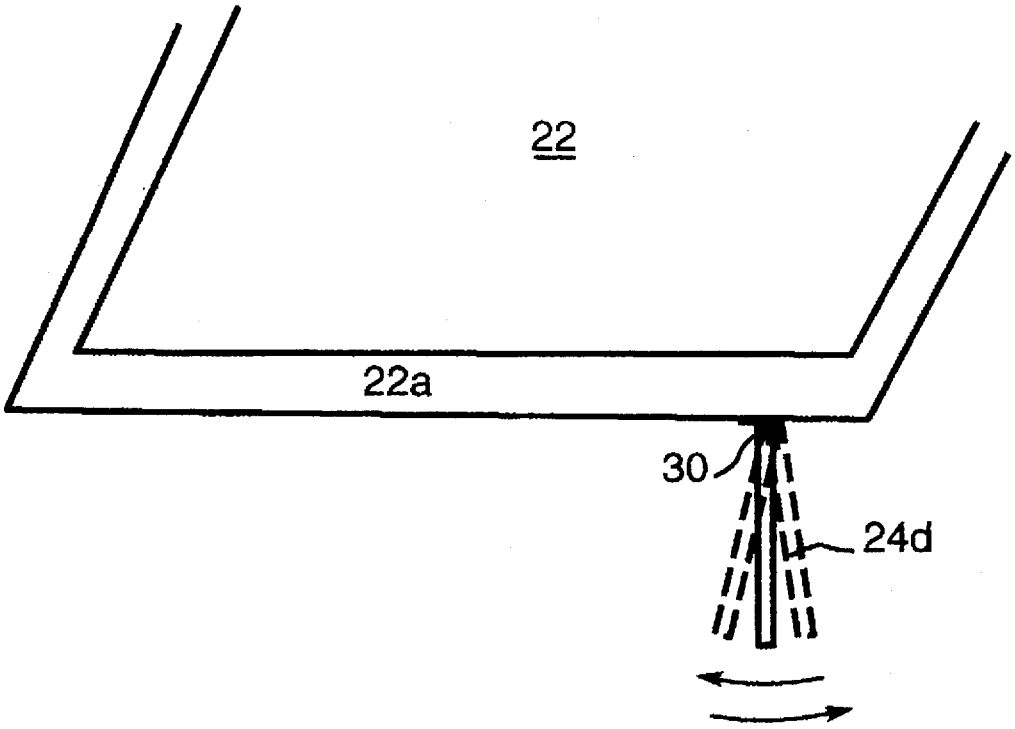
FIG. 4 is a cross sectional view showing how the support flaps of the top unit are connected by hinges to the tabletop.

FIG. 4 shows hinge 30 connected, as, for example, by screws, to the bottom underside of tabletop 22 and the inner surface of support flap 24*d* at one end thereof. Although not shown in FIG. 4, hinge 30 connects to tabletop 22 and support flaps 24*c* and 24*d* at each of the other ends in the same manner.

As previously explained, when the assembly is in the closed position functioning as an ottoman, support flaps 24*c* and 24*d* hang on their hinges at approximately a right angle to tabletop 22 over the outside surface of outer walls 12 and 14. Tabletop 22 rests on top of base unit 10.

When it is desired to convert the assembly into a game or snack table, top unit 20 is pulled upwards, as previously explained. When support flaps 24*c* and 24*d* reach the position that they are no longer restrained by outer walls 12 and 14, a slight pressure inwards will cause them to rest on the top corners of outer walls 12 and 14.

Figure 5:
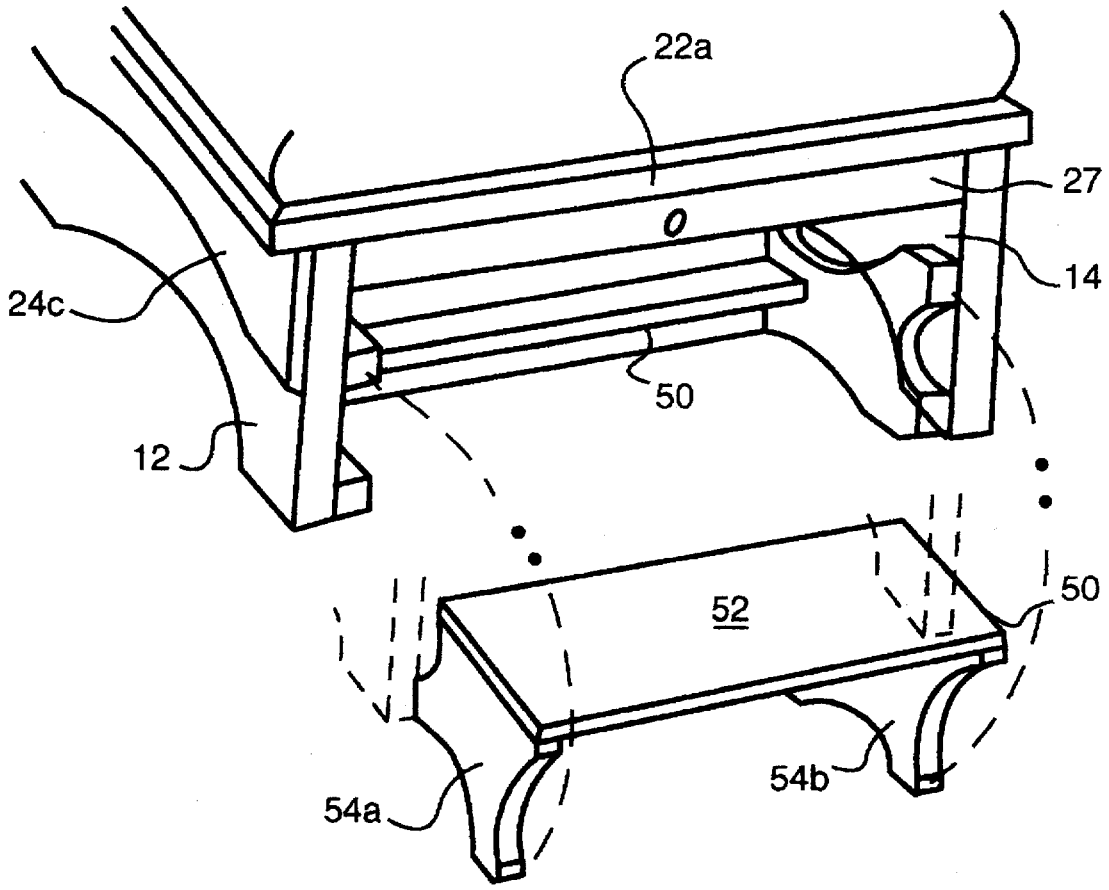
FIG. 5 is a perspective view showing the optional step or footstool stored within the base unit and when opened for use.

FIG. 5 shows the optional footstool or step 50 stored within base unit 10 and as projected into its open position.

As shown, step 50 comprises top 52 attached to third wall means 54*a* and 54*b*. Step 50 is attached to outer walls 12 and 14, as, for example, by a nut and bolt or a screw through each of the back ends, respectively, of wall means 54*a* and 54*b* such as to allow step 50 to be rotated through an am from a stored to an open position and vice versa. The means used to affix step 50 to outer walls 12 and 14 is not limited to screws or nuts and bolts. Any system that allows the desired rotation is acceptable.

In the preferred embodiment, step 50 measures 7⅜ inches high and 15 ⅞ inches wide. Wall means 54*a* and 54*b* are 5⅞ inches long and 7⅜ inches high, and step 50 is made of ¾-inch thick plywood. However, as previously explained, the invention is not limited to these materials nor even to wood.

The foregoing embodiment is illustrative of the present invention and is not to be construed as limiting thereof. The invention is defined by the following claims, with equivalents to be included therein.

What is claimed is:

1. A convertible ottoman assembly, comprising:

A base unit configured to rest on an underlying surface and including at least two equally-dimensioned outer walls separated from each other by a distance and attached to each other by a frame; and A top unit, including a tabletop configured to receive a cushion and having at least two equally-dimensioned inner walls separated from each other by a distance and rigidly affixed to said tabletop, the distance between said inner walls being less than the distance between said outer walls, and the length of said inner walls being less than the length of said outer walls, and said top unit further having at least two equally-dimensioned support flaps, with a height less than the height of said inner walls, each of said support flaps hanging parallel to the outer surfaces of each of said inner walls, said support flaps being affixed to said tabletop by attachment means enabling said support flaps to be moved inward and outward such that when said inner walls are lowered inside said base unit, said support flaps are simultaneously lowered over the outside of said outer walls such that said tabletop rests on said base unit in a closed position, thereby creating an ottoman; and further when said inner walls are raised upwards, said support flaps are caused to rest securely on the top of said outer walls against said inner walls in an open position, thereby creating a table.

2. The convertible ottoman assembly of claim 1, further comprising a cushion configured to fit on top of said tabletop.

3. The convertible ottoman assembly of claim 1, further comprising a slideable drawer under said tabletop of said top unit.

4. The convertible ottoman assembly of claim 1, further comprising a footstool attached to said outer walls such as to allow said footstool to be moved through an arc from a closed storage position to an open footstool position.

5. The convertible ottoman assembly of claim 1 wherein said attachment means of said support flaps is a hinge configured to maintain said support flaps at an angle of approximately 90 degrees to said tabletop when said top unit and said base unit are disassembled at a slightly greater angle relative to said tabletop when said assembly is in said closed position, and at a slightly lesser angle relative to said tabletop when said assembly is in said open position.

6. A convertible ottoman assembly, comprising:

A base unit having two equally-dimensioned outer walls separated from each other by a distance and attached to each other by support means along a horizontal plane, such that said base unit is configured to rest on an underlying surface; and A top unit having a tabletop configured to receive a cushion and having two equally-dimensioned inner walls separated from each other by a distance and rigidly affixed to said tabletop, wherein the distance between said two inner walls is less than the distance between said two outer walls, and the length of said inner walls is less than the length of said outer walls, and further having two equally-dimensioned support flaps with a height less than the height of said inner walls and affixed by hinge means to said tabletop so as to hang approximately parallel to the outer surfaces of said inner walls and partially covering the outside surfaces of said inner walls, said hinge means enabling said support flaps to be moved inward and outward;

Whereby when said support flaps are moved outward, said inner walls are enabled to fit within said base unit and said tabletop to rest on said base unit, and, when said top unit is pulled upwards from within said base unit, said support flaps are enabled to be moved inward such as to rest on the top of said outer walls against said inner walls.

7. The convertible ottoman assembly of claim 6, further comprising a cushion configured to fit on top of said tabletop.

8. The convertible ottoman assembly of claim 6, further comprising a slideable drawer under said tabletop of said top unit.

9. The convertible ottoman assembly of claim 6, further comprising a footstool attached to said outer walls such as to allow said footstool to be moved through an arc from a closed storage position to an open footstool position.

* * * * *